United States Patent [19]

LeTourneau

[11] Patent Number: 4,722,640

[45] Date of Patent: Feb. 2, 1988

[54] SLANT LEG OFFSHORE PLATFORM AND METHOD OF OPERATING SAME

[76] Inventor: Richard L. LeTourneau, 1 Huntington Cir., Longview, Tex. 75601

[21] Appl. No.: 412,984

[22] Filed: Aug. 30, 1982

Related U.S. Application Data

[63] Continuation of Ser. No. 910,442, May 30, 1978, abandoned, which is a continuation-in-part of Ser. No. 750,606, Dec. 15, 1976, abandoned.

[51] Int. Cl.[4] ..... E02B 17/08

[52] U.S. Cl. ..... 405/196; 114/265

[58] Field of Search ..... 114/264, 265; 405/195, 405/196, 197, 198, 199, 200, 203; 254/105, 106, 107; 37/73

[56] References Cited

U.S. PATENT DOCUMENTS

| | | | |
|---|---|---|---|
| 2,526,092 | 10/1950 | Snyder | 254/187 A |
| 2,592,448 | 4/1952 | McMenimen | 405/196 |
| 2,917,851 | 12/1959 | Ellicott, Jr. | 37/73 |
| 2,932,486 | 4/1960 | Suderow | 405/199 X |
| 2,944,403 | 7/1960 | Smith | 405/199 |
| 2,967,400 | 1/1961 | Grant et al. | 405/199 |
| 3,183,676 | 5/1965 | Tourneau | 405/196 |
| 3,325,923 | 6/1967 | Cargile, Jr. | 37/73 |
| 3,367,119 | 2/1968 | Rybicki | 405/196 |
| 3,392,534 | 7/1968 | Blenkarn | 405/196 |
| 3,804,369 | 4/1974 | Sutton | 405/203 |
| 3,916,633 | 11/1975 | Lovie et al. | 405/203 |
| 4,090,367 | 5/1978 | Verschure | 405/195 |

*Primary Examiner*—Sherman D. Basinger

*Attorney, Agent, or Firm*—Dodge, Bush & Moseley

[57] ABSTRACT

A relatively inexpensive, mobile type of offshore structure has truss-type legs constructed of smoothly cylindrical chords and braces whereby the portions of the legs exposed to wave and wind forces, when the unit is in operation, are practically free of the usual turbulence-producing protuberances and recesses. The legs are powered to move vertically in relatively large guides which are pivoted to the support platform. Wedges may be operated to tilt and/or hold the legs in desired slant position as the legs approach bottom. Also, as the legs approach bottom, they are released from the platform and their rate of descent is sharply increased so that all legs will impact the bottom at substantially the same time. The leg slant holding wedges are released as the legs strike bottom so that the platform is free to rock, rise, and fall independently of the legs, under wave action.

14 Claims, 17 Drawing Figures

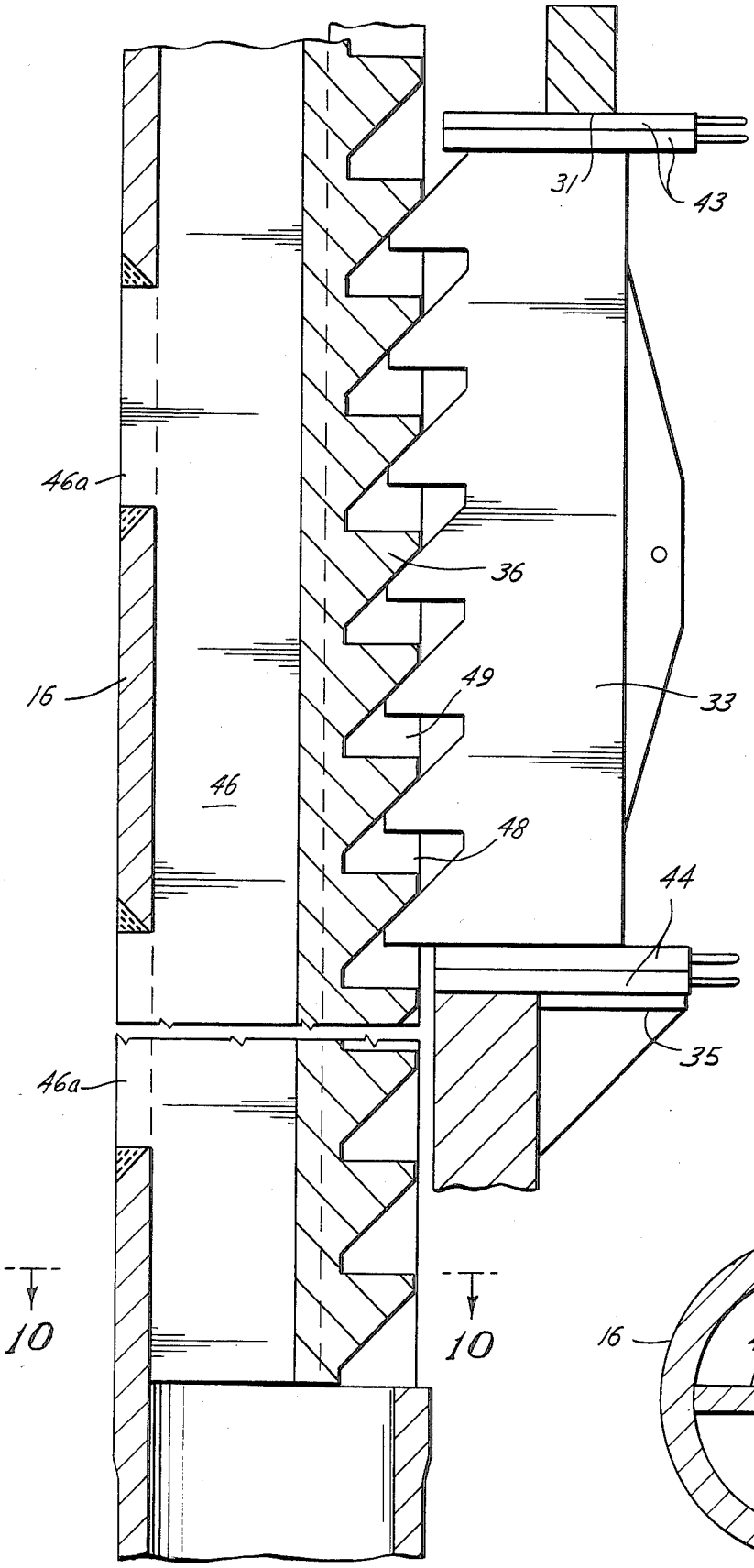
Fig. 9
Fig. 10
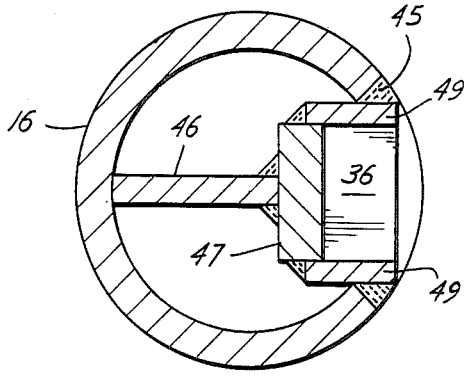

SLANT LEG OFFSHORE PLATFORM AND METHOD OF OPERATING SAME

RELATED APPLICATION

This application is a continuation of my application, Ser. No. 910,442, filed May 30, 1978, and now abandoned, which is a continuation-in-part of my application, Ser. No. 750,606, filed Dec. 15, 1976, now abandoned.

BACKGROUND OF THE INVENTION

This invention relates to offshore, deep water structures, particularly of the mobile or jack-up type, for instance, for oil well drilling, testing, or production operations.

The utility of conventional structures of this type is limited to going onto and off locations in relatively calm weather conditions and low wave heights which may exist for only short time periods and to relatively shallow waters with bottom conditions more or less even and consistent, and because of their great cost. This is due in part to the relatively high resistance they offer to environmental forces in rough waters resulting, in part, from the turbulence producing teeth or holes or other anomalies provided along the legs for use in manipulating the legs.

Slanting of the legs has marked advantages, but, heretofore, slant leg platforms have not been wholly satisfactory, particularly in deep, rough waters, where they would be most advantageous. This is due to the impossibility of maintaining the legs at substantially uniform angles; the great danger is that less than all the legs may engage the bottom during descent and thereby be subjected to excessive and dangerous bending and twisting forces. Leg operating mechanisms current in offshore drilling rigs power the legs up and down at relatively slow rates. Thus, if the hull should be lifted or rocked just as the legs approach the bottom, a leg mechanically attached to the platform may be lifted free of the bottom even though leg lowering continues, so that the affected leg, at its next descent, may strike the bottom at a different point thus changing the leg angle, possibly with destructive results. As the hull is lifted in and from the water, the leg angularity maintaining means must be released, but when such means is released before the legs have arrived at their final location on or in the ocean bottom, a lifted leg, as by wave action, will inevitably pivot by gravity action toward vertical, again disturbing the support symmetry. Moreover, in case the operator should not release the angle maintaining means together and at the correct moment of contact with the bottom, simultaneously with lifting of the hull, a difficult task, destruction of the leg attaching mechanism or damage to the leg could result.

SUMMARY OF THE INVENTION

Accordingly, an object of the invention is to provide novel means for insuring rapid, substantially simultaneous impacting of all legs of a mobile type offshore, deep water platform on the water bottom to avoid the dangers mentioned above.

Another object is to provide novel, effective means for insuring substantially uniform angling of the slant legs of such a barge, as they near and strike the bottom together, and means for promptly releasing such means as the legs engage the bottom.

Another object is to provide novel means for resisting lateral displacement of the lower ends of the legs after they have impacted the water bottom.

In accordance with the present invention, the hull or other platform structure for carrying drilling and/or other equipment, has symmetrically positioned pivoted guides for the inner chords of truss or lattice type legs. Tapered clearances are provided between the guides and the platform and powered mechanisms are provided for pivoting the legs to the desired angularity and including wedges or blocks for enforcing and/or maintaining such angularity until the legs have impacted the bottom. The legs and platform are raised and lowered by instrumentalities, as winches, through tension lines, chains or cables, controls being provided for releasing most but not all of the restraint on the leg manipulating lines, as the legs reach proximity to the bottom, so the legs will rapidly drop together, say during the last ten feet of descent to the bottom. Substantially as the legs strike bottom, the wedges will be withdrawn to release the legs to permit safe vertical fluctuation of the hull by wave action and lifting of the hull. The lower, spear ends of the legs are of frusto-conoidal shape with the outer faces more bluntly angled than the inner faces to augment resistance to outward spreading of the bottom embedded legs.

Toothed dogs or slides are provided on the platform for cooperating with complementary short rack sections on the inboard leg chords to lock the legs and platform selectively in their raised positions. Substantially all surfaces of the leg chords and braces below the platform, when the legs are lowered, except the mentioned short rack sections, are smoothly tubular and streamlined for minimum water resistance.

BRIEF DESCRIPTION OF THE DRAWINGS

FIG. 9 is an enlarged, longitudinal section showing the platform supports parts.

FIG. 10 is a section taken on line 10—10 of FIG. 9.

DETAILED DESCRIPTION OF THE DRAWINGS

Figure 1:
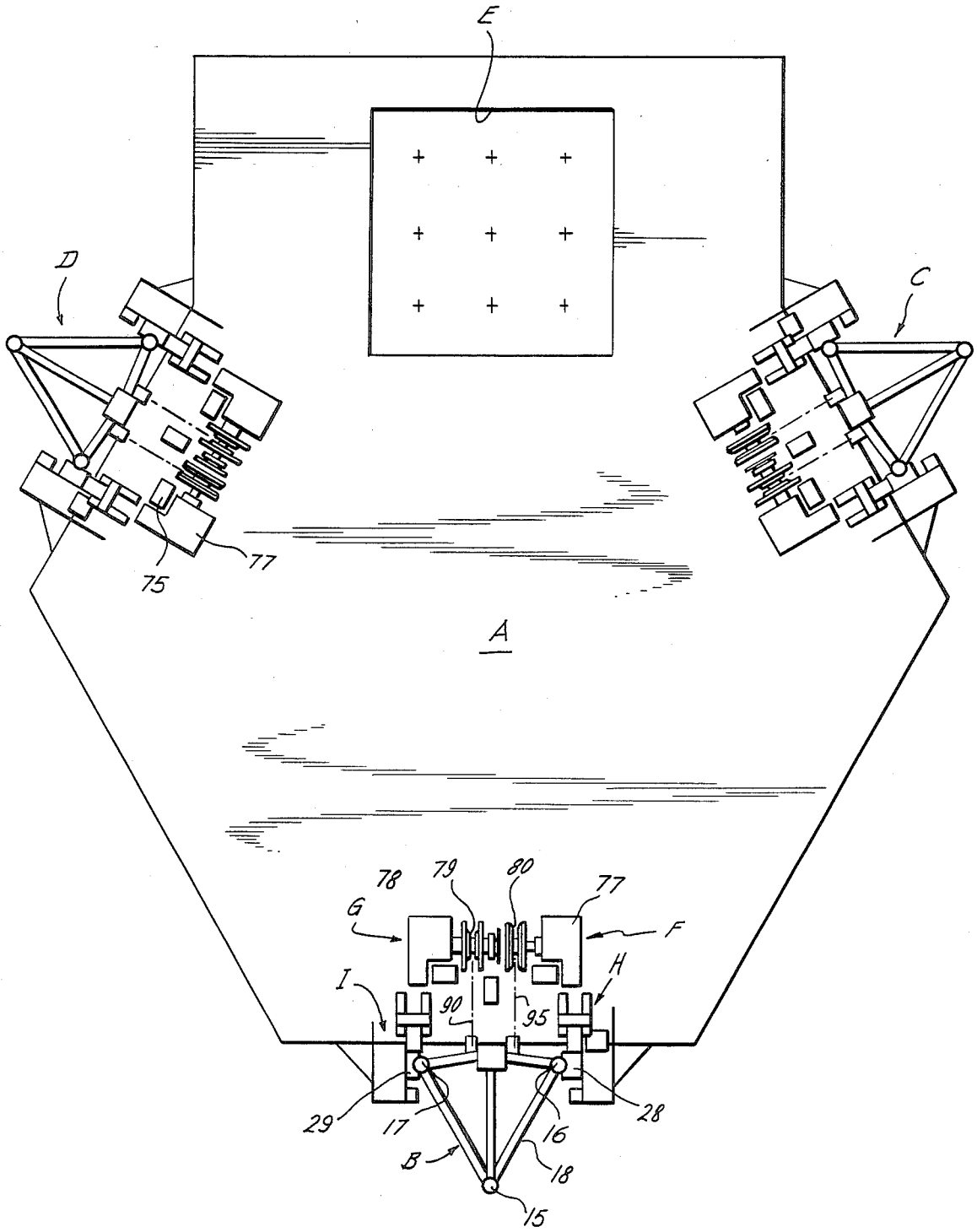
FIG. 1 is a plan view of an offshore platform embodying the invention.
Figures 3, 3A:
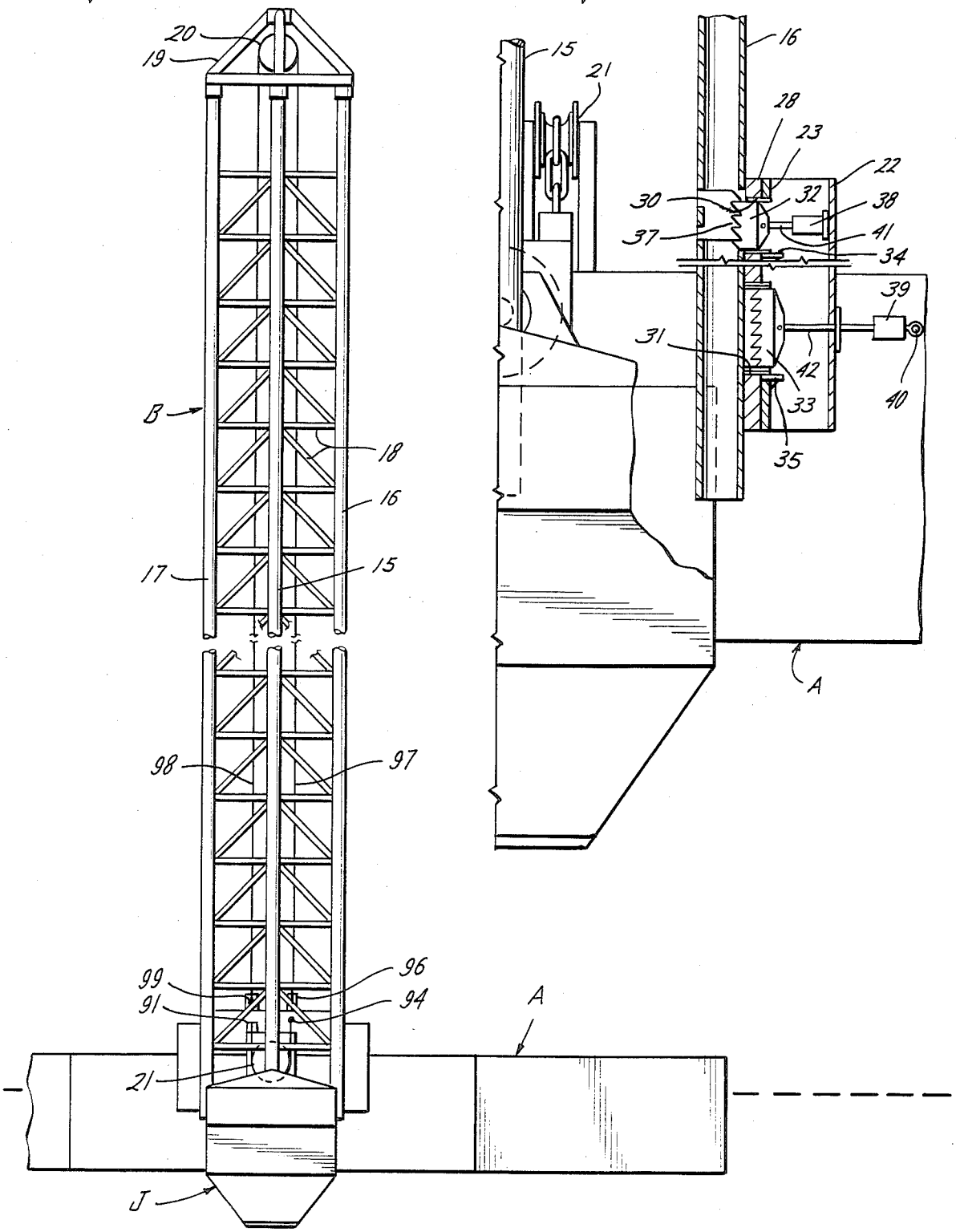
FIG. 3 is an outside elevation showing one of the legs in elevated, transport position on the platform or hull.
FIG. 3A is an enlarged detail view of the structure in FIG. 3, parts being broken away to illustrate underlying parts.

FIG. 1 shows in plan an eight sided platform A having three truss-type legs B, C, and D symmetrically and slidably carried thereby and a drilling opening E. Drilling and other equipment is omitted from the drawing as not necessary for understanding of the invention. Just inwardly of each leg are leg handling mechanisms F and G and leg guiding, slanting, and locking mechanisms H and I to be described in detail hereafter. At the base of each leg is the novel spear footing J (FIG. 3). All legs and control mechanisms are identically constructed and only one will be described.

Each leg consists of three longitudinal chords 15, 16, and 17 connected by a multiplicity of braces 18 (FIGS. 2 and 3), all of tubular (cylindrical) form and therefore streamlined. The chords are firmly secured at the bottom to footing J mounting the base sheave wheel 21 and, at the top, to a frame 19, preferably removable, which mounts an idling crown sheave wheel 20, wheels 20 and 21 being just inward of the general plane of inboard chords 16 and 17.

Figure 2:
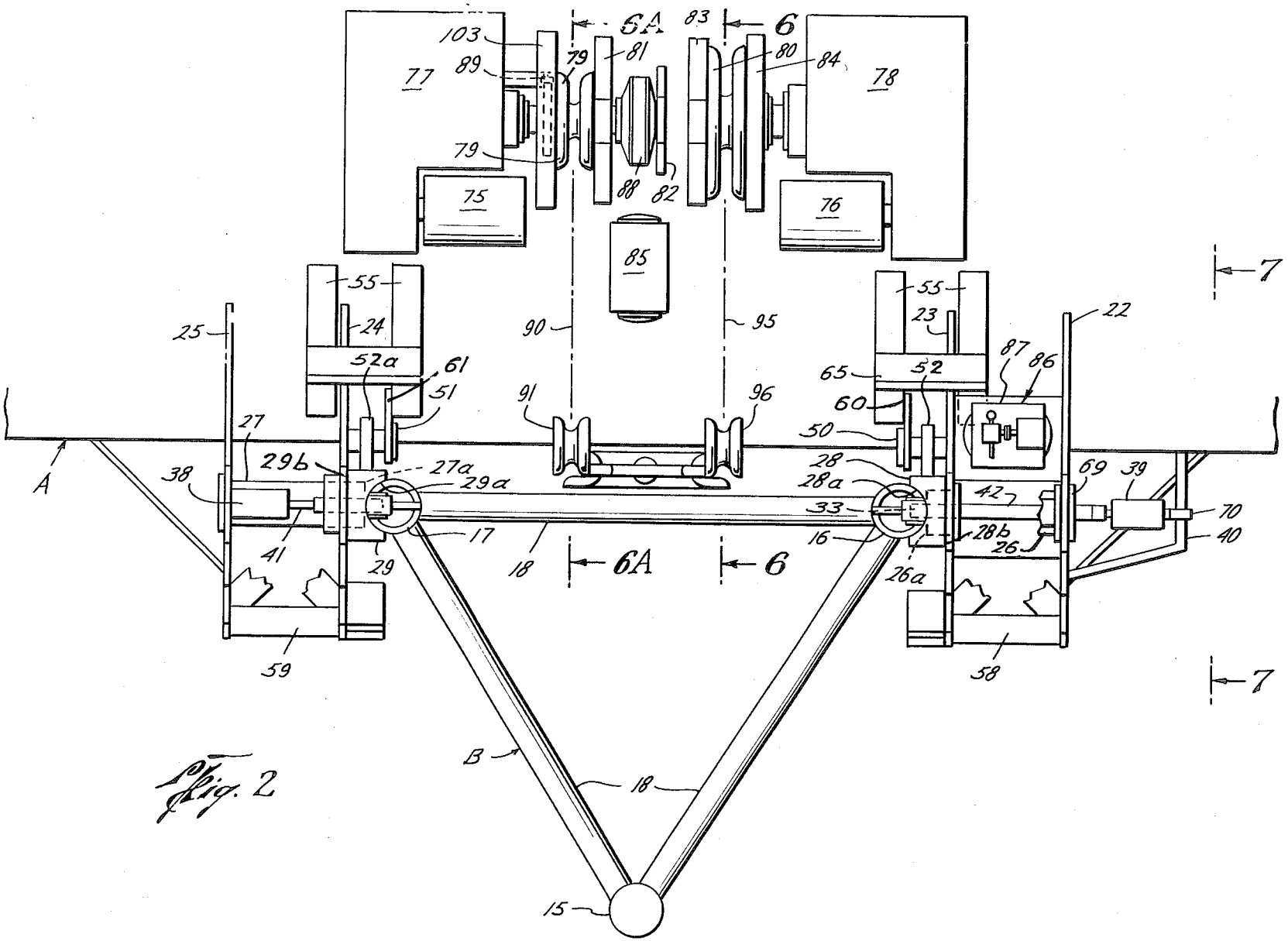
FIG. 2 is an enlarged plan view of a part of the structure in FIG. 1, portions being broken away.
Figure 7:
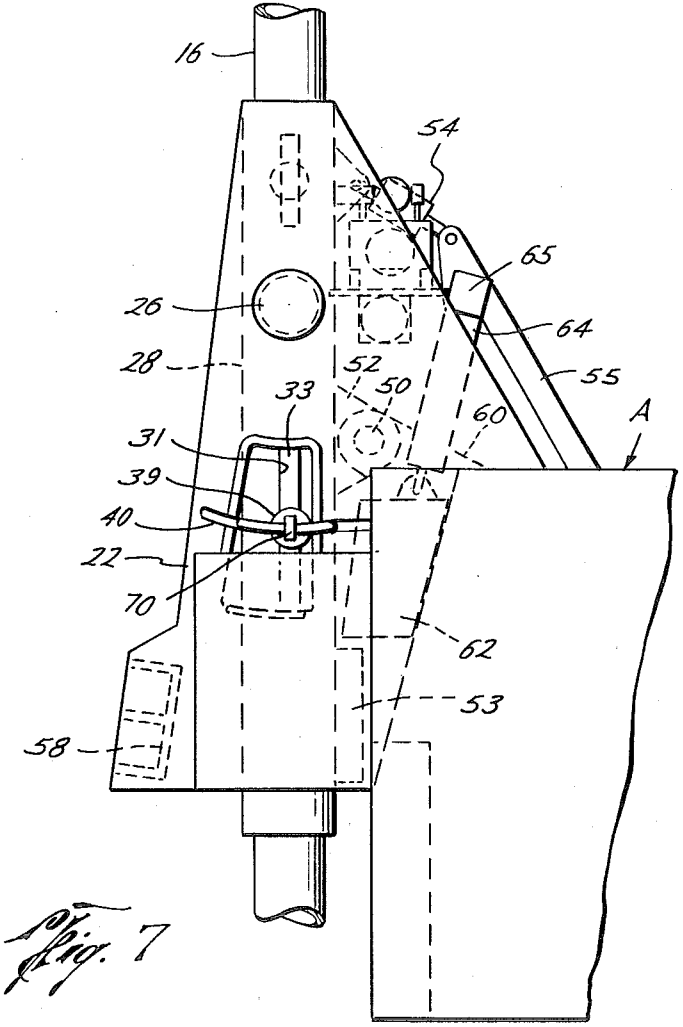
FIG. 7 is a side view taken on line 7—7 of FIG. 2 showing the leg chord in upright position.

FIGS. 2 and 7 show with greater clarity the leg guiding and control arrangements. Pairs of heavy braced ribs 22, 23, 24, 25 project outwardly from the edge of the platform, at opposite sides of the corresponding leg. Extending between the pairs somewhat outwardly of the platform are heavy pivot pins 26 and 27 which extend slightly inwardly of the inner ribs 23, 24, as at 26*a*, 27*a*, and there form journals rotatably received in suitable bearings in leg chord guides 28, 29. These pivoted guides have inwardly opposed, approximately semicircular bearing faces 28*a* and 29*a* which slidably receive the outwardly opposite faces of inboard leg chords 16 and 17. The opposite outward faces of the leg guides are in close juxtaposition with rugged inner ribs 23 and 24, as at 28*b* and 29*b*, for transmitting forces between the legs and the platform. Formed in each guide, respectively above and below the pivot pins, are elongated rectangular windows 30 and 31 (FIGS. 3A and 9) which slidably receive similarly shaped but slightly smaller toothed locking dogs 32 and 33 supported on ledges 41 and 35 projecting from the guide portion.

For cooperating with the locking dogs, the inboard leg chords 16 and 17 are provided, respectively, near their upper and lower extremities, with short sections of buttress teeth 36 (FIG. 9) and 37 (FIG. 3A), complementary, respectively, with the teeth of locking dogs 33 and 32. The upper chord toothed sections 36, which adjustably support the platform when elevated (FIGS. 8 and 9) are substantially longer than the lower toothed sections, which need only support the weight of the fully raised leg (FIGS. 3 and 3A), as will be explained.

Figure 7A:
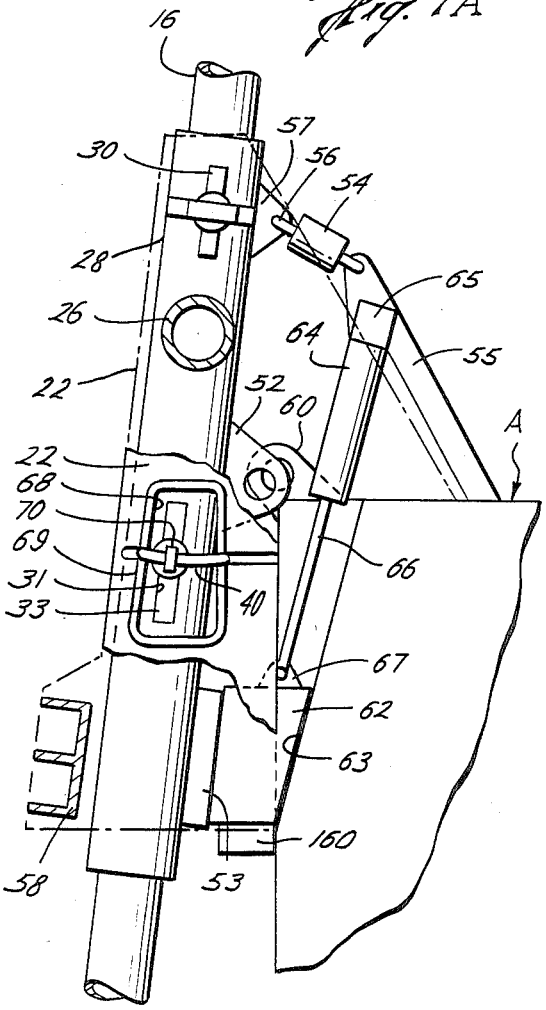
FIG. 7A is a view of the structure as in FIG. 7, but showing the leg chord in slanting position, portions being broken away to better illustrate underlying parts.
Figure 11:
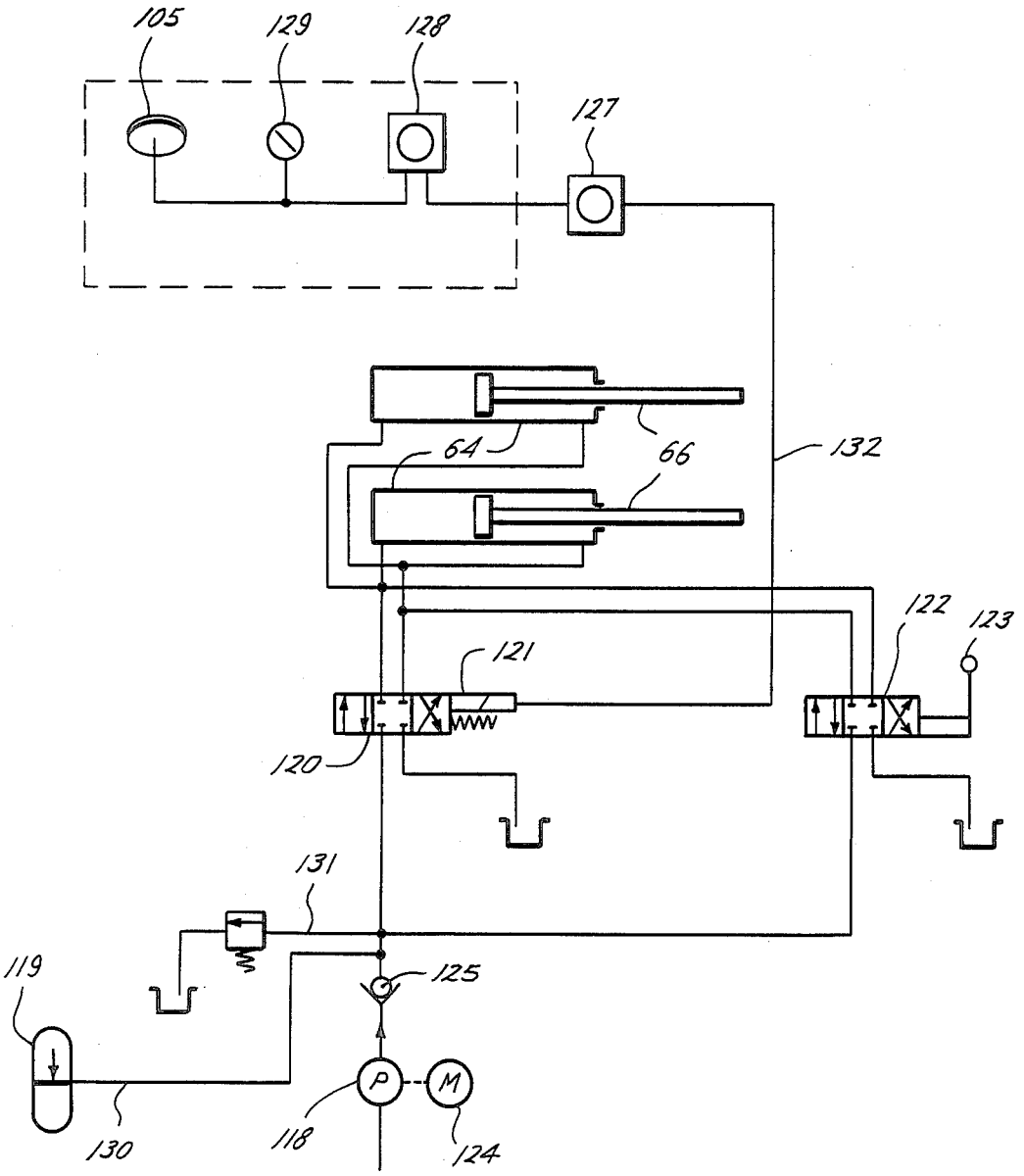
FIGS. 11, 12, 13, and 14 are control diagrams.

As shown in FIG. 3A, the sliding locking dogs 32 and 33 are actuated, respectively, by double acting fluid motors 38 and 39, mounted between pairs of ribs 22 and 23, motor 39 being slidable on and reacting against a curved bar 40 (FIGS. 3A, 7 and 7A). Fluid motor 38 is connected to leg supporting toothed dog 32 by piston rod 34, while motor 39 is connected to platform supporting toothed dog 33 by piston rod 42. In FIG. 3A, dog 32 is engaged with toothed chord section 37 in supporting the leg in its fully elevated position (FIG. 3). FIG. 9 shows toothed dog 33 engaging, but not yet fully meshed with a portion of toothed chord section 36, with the platform or hull A fully elevated. It will be understood that the cooperating locking dogs and toothed chord sections are provided for both inboard chords of the leg. In case, as shown in FIG. 9, a dog 33 cannot fully register with the appropriate chord teeth for any reasons, shims, as 43 and 44, may be redistributed, as needed.

FIGS. 9 and 10 show an exemplary arrangement of the toothed chord sections used in supporting the platform. One side of the hollow chord is cut away, as at 45, to receive the longitudinal, diametral web 46, backing plate 47, side walls 49, and teeth 36. With the opposite edge of the web firmly lodged against the inner chord wall and lugs 46*a* fitting in the slots in the chord wall, the lugs, side walls 49, and web 46 are welded in place as shown to form a very strong, rigid rack structure. Both toothed sections may be formed the same way.

The leg inboard chords may be secured in upright position by means of pins 50 and 51 (FIGS. 2, 7, and 7A) seated in registered holes in lugs 52 and 52*a*, projecting from guides 28 and 29, and other lugs or brackets 60 and 61 rigid with the platform or hull deck and inner ribs 23, 24. In the vertical leg positions (FIG. 7), one outer side of each guide 28, 29, abuts an inner stop plate 53 extending between rigid platform ribs 22, 23 and 24, 25. In order to slant the leg, double acting fluid motors 54, pivotally secured to and reacting against upstanding dual platform structures 55, have piston rods 56 pivotally connected to lugs 57 on guides 28 and 29 (FIG. 7A). Contraction of motors 54 draws the guides and, with them, the legs to the selected slant positions, say 7°–10° from vertical. Outer stop bars 58 and 59 limit the inclination of the leg. Preferably, however, the leg guides should slightly clear bar 58 in its operative, slant position.

In order to firmly hold the legs in the desired slant position during descent and, possibly, when the platform or hull is in elevated, working position, each leg chord is provided with a wedge or block 62 (FIG. 7A) which is lodged between the wedge matching stop plate 53 on the pivoted guide and the inclined side face 63 on the platform. The wedge rests in its lower position on barge protrusion 160. The wedge is actuated by a two-way fluid motor 64 reacting against a cross bar 65 connecting upstanding platform braces 55. Piston rod 66 of motor 64 is pivotally connected to a lug 67 on the wedge. The wedge is elevated when the leg chord is vertical, as in FIG. 7. Jointly actuated chord angularity controls are provided for both inboard chords of each leg, as will be further described later.

Formed in each outer platform rib 22, 25 in line with platform support toothed rack section 33 and its motor 38 or 39, is a window, as 68. (FIGS. 2, 7 and 7A) with a peripheral reinforcing collar 69. Traversing the outer face of window 68 is the vertically curved bar 40 which slidably receives the loop 70 at the back end of fluid motor 39. Since platform supporting toothed dog 33 makes a close but slidable fit in window 31 in the corresponding chord guide, the dog, piston rod 42, and motor 39 will be carried therewith during pivoting of the leg between the upright and slant positions of FIGS. 7 and 7A, loop 70 riding along curved bar 40. Windows (not shown) shaped similarly to and in line with windows 68 will be provided in inner ribs 23 and 24 to accommodate the pivotal motion of toothed slide 33. Since the legs will be locked by their slides 32 only when the legs are fully elevated and vertical, the windows 30 provided therefore in ribs 23 and 24, may closely approximate the shape and size of the toothed slide 32.

The stability of the legs is further enhanced by the close juxtaposition of the back faces 28b and 29b of the chord guides with the faces of heavy ribs 23 and 24. Preferably, slight clearance is provided normally between these confronting faces, but the faces may contact in case of biasing forces applied to the leg or platform.

LEG AND PLATFORM RAISING AND LOWERING MECHANISMS

Special leg and platform elevating mechanisms are provided in order to simplify the construction of the rig and to avoid the necessity of forming the usual recesses and/or protuberances in and on major portions of the leg chords below the platform when elevated. Specificially, the portions of the leg surfaces in the air gap between the platform and water surface, at the air and water interface, and in the water above the bottom latch teeth, that is, all the leg portions subject to substantial air and water movements and turbulence, are free of the mentioned recesses and protuberances. As shown in FIGS. 1 and 2, there is mounted on the platform, adjacent each leg, a pair of electric motors 75 and 76 actuating winch sheave wheels 79 and 80, supported in trunnion blocks 81, 82, 83, and 84, through gear trains in gear boxes 77 and 78. Sheave wheels 79 and 80 are of the so-called "wildcat" type for driving chains. However, other types of tension lines, for instance wire rope, may be used with suitable winch drums, multiple blocks and/or other rigging. The housing 85 (FIG. 2) accommodates a hydraulic motor, pumps, accumulators, and controls. Other controls are shown at 86 mounted on a base plate 87. A jaw type clutch 89, is interposed between gear box 77 and leg lifting and lowering sheave wheel 79. A hydraulic motor 88 functions to retain tension on the leg lines, as will be explained, when the leg strikes bottom. A similar arrangement may be provided for tensioning the hull lifting lines as the hull rises and falls.

Figure 8:
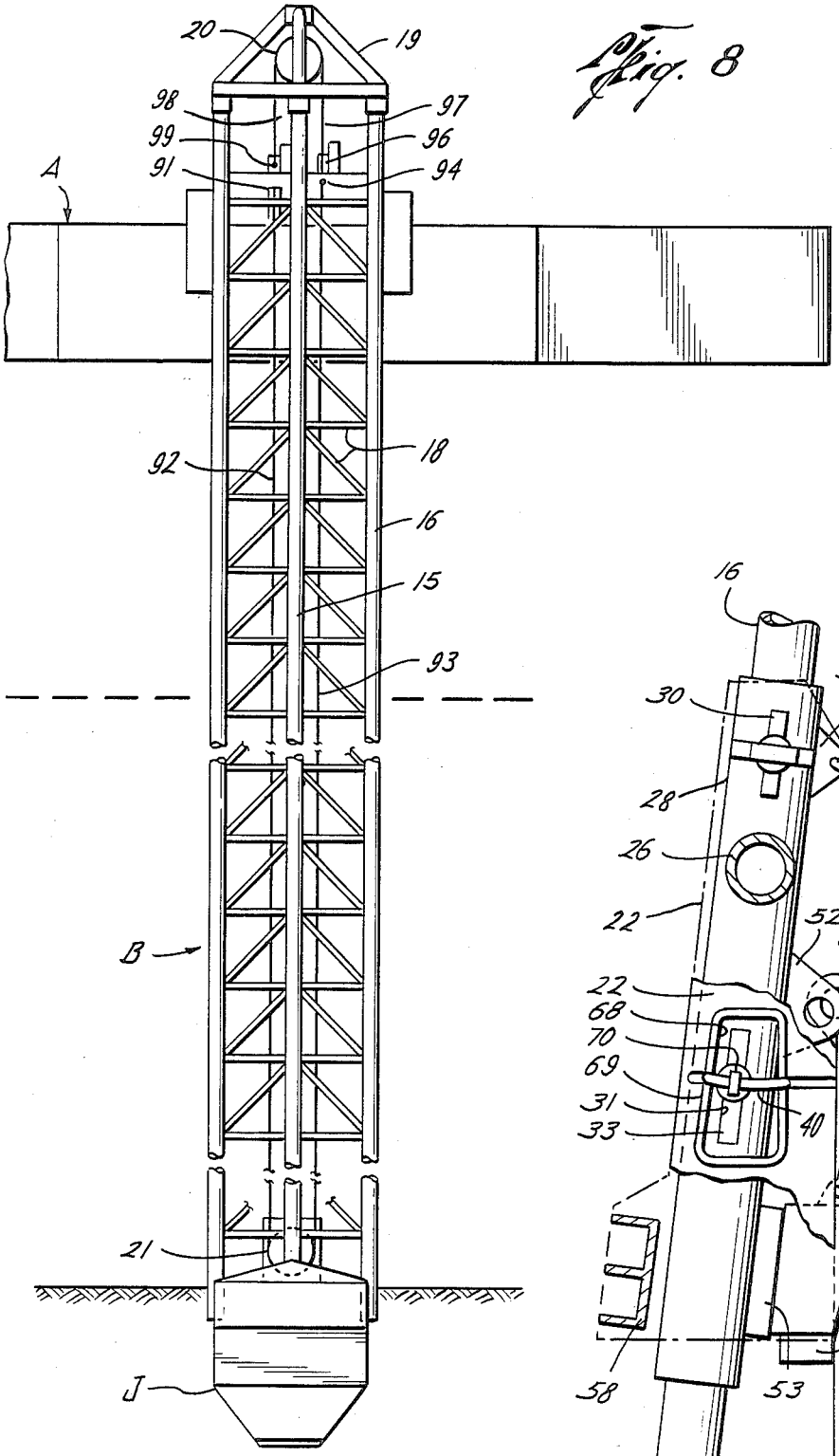
FIG. 8 is an outside elevation of one leg and the elevated platform or hull.

The leg operating tension chain passes from storage, around winch sheave 79, thence, as at 90 (FIG. 2), over direction-changing idler pulley 91, downwardly along the inner face of the leg, as at 92, around bottom idler pulley 21 on leg footing J, and upwardly, as at 93, to tie-off point 94 on the platform (FIG. 8). The platform or hull operating tension chain passes from storage over winch sheave wheel 80, thence, as at 95, to and under direction-changing idler 96, upwardly along the leg, as at 97, (FIGS. 3 and 8), around top idler sheave 20, and then downwardly, as at 98, to tie-off 99 on the platform.

Figure 6:
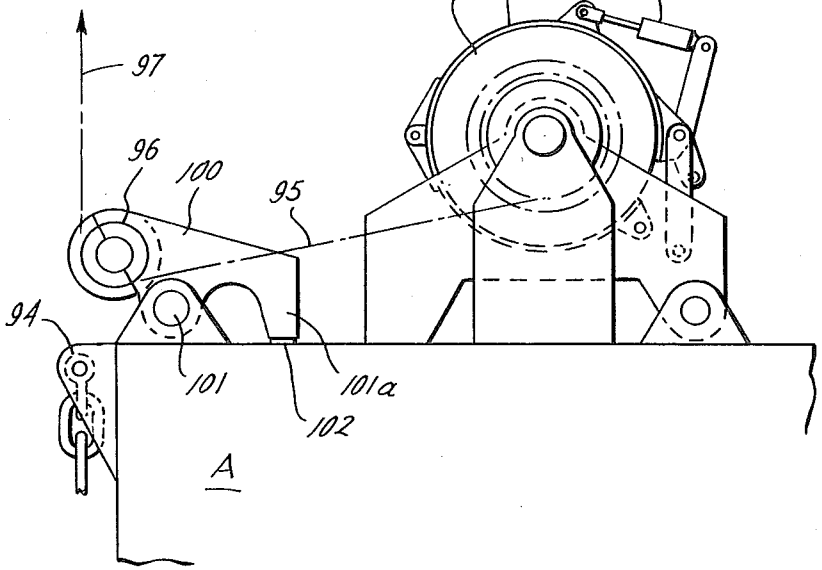
FIG. 6 is a vertical section taken on line 6—6 of FIG. 2.

FIG. 6 illustrates the mounting bracket 100 for direction-changing idler 96. The bracket is pivotally secured at 101 to platform A and has an arm 101a on the side of the pivot opposite idler wheel 96 which bears against a load cell 102. The arrangement is such that when tension is applied to line 97, an electric signal is generated by the load cell. FIG. 6 also shows a band brake 103 applied to a drum 104 rigid with "wildcat" sheave wheel 80. A fluid motor 107 can tension the band brake to lock winch sheave wheel 79 independently of gear train 77 and motor 75, but normally is used as additional braking.

Figure 6A:
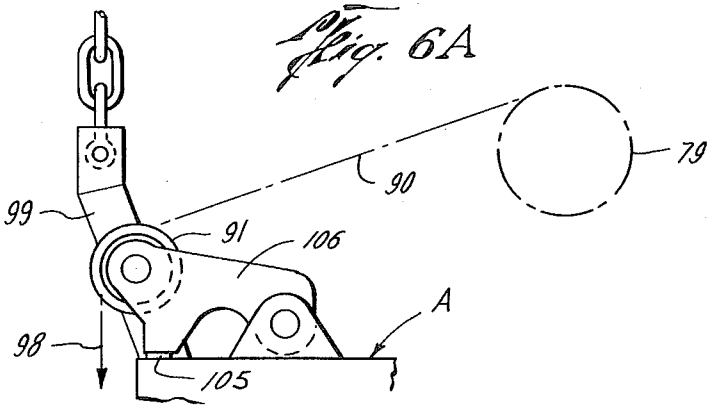
FIG. 6A is a detail section taken on the line 6A—6A of FIG. 2.

FIG. 6A shows a similarly arranged load cell 105 associated with the pivoted bracket 106 mounting direction-changing idler 91 in such a way that application of tension to the line 90, 98, and relief of the tension, generate different signals, as when the leg approaches and strikes bottom.

Figure 4:
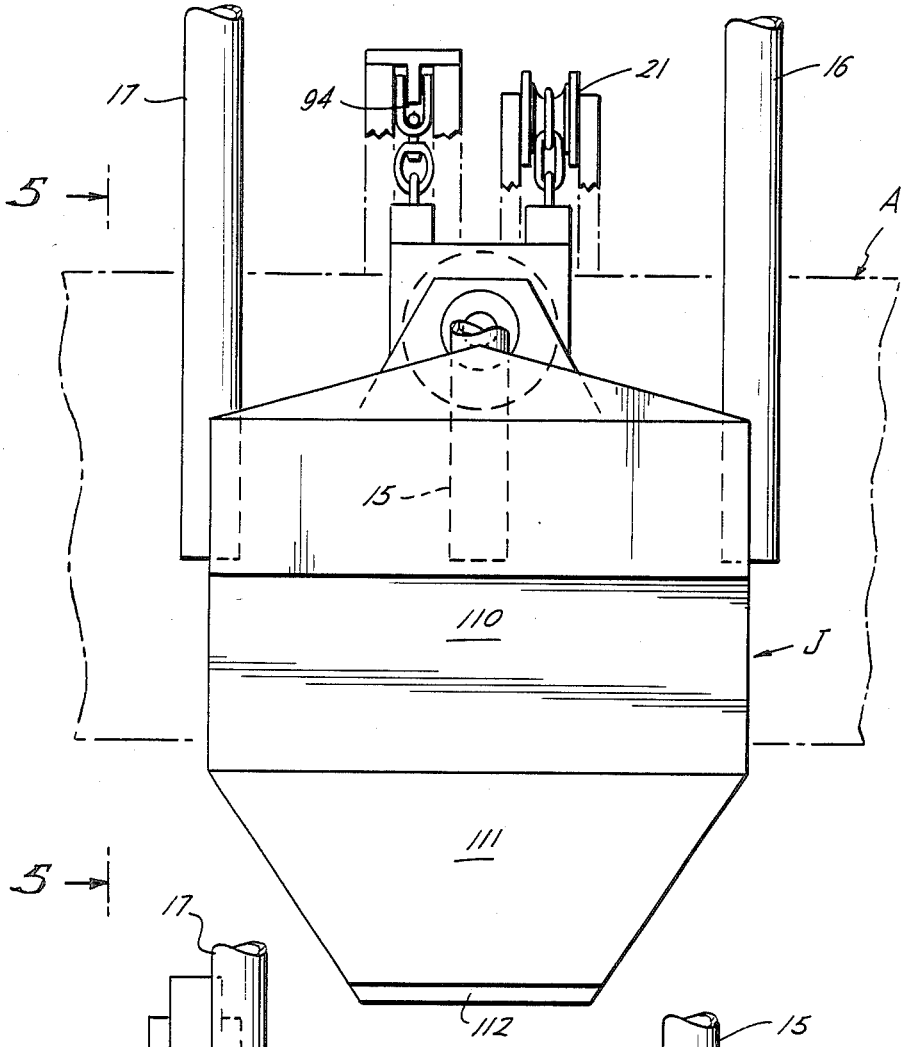
FIG. 4 is an enlarged view of the leg footing, as in FIG. 3.
Figure 5:
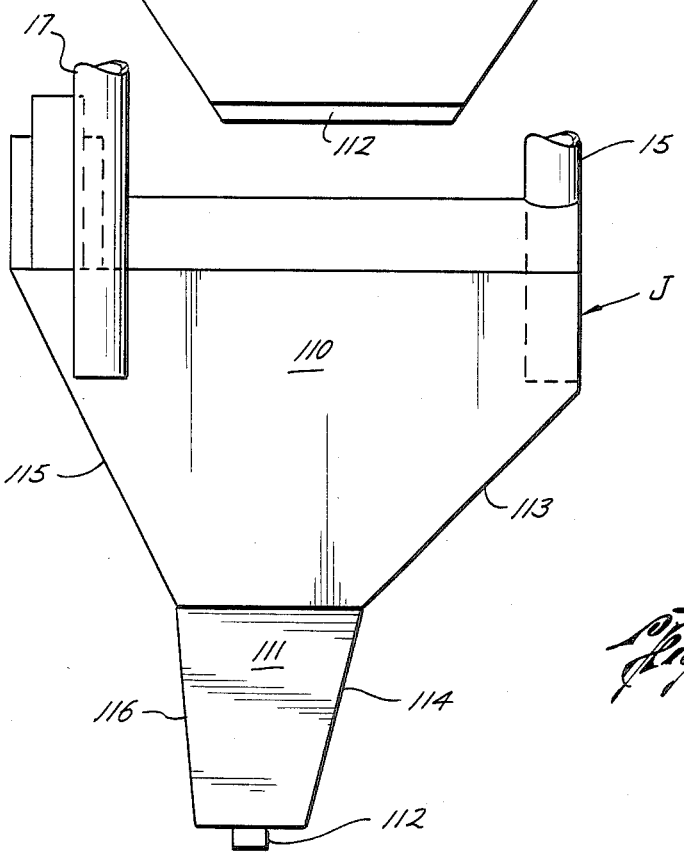
FIG. 5 is a view of the structure in FIG. 4, taken at 90° thereto and on line 5—5 of FIG. 4.

FIGS. 4 and 5 show a means for resisting the tendency of the slant leg footings to slip outwardly in the speared water bottom. The general shape of the novel footing is compound frusto-conoidal with upper and lower parts 110 and 111 and a bottom edge 112 designed to initially spear the bottom upon impact, while tending to blunt the ensuring penetration rate. The outer faces 113 and 114 of the footing make greater angles with the leg axis, that is blunter angles than the opposite footing faces 115 and 116. The resultant unequal resistance to penetration of the opposed, differently angled faces has the effect of biasing the slant leg in opposition to the outward component of the slant.

Figure 13:
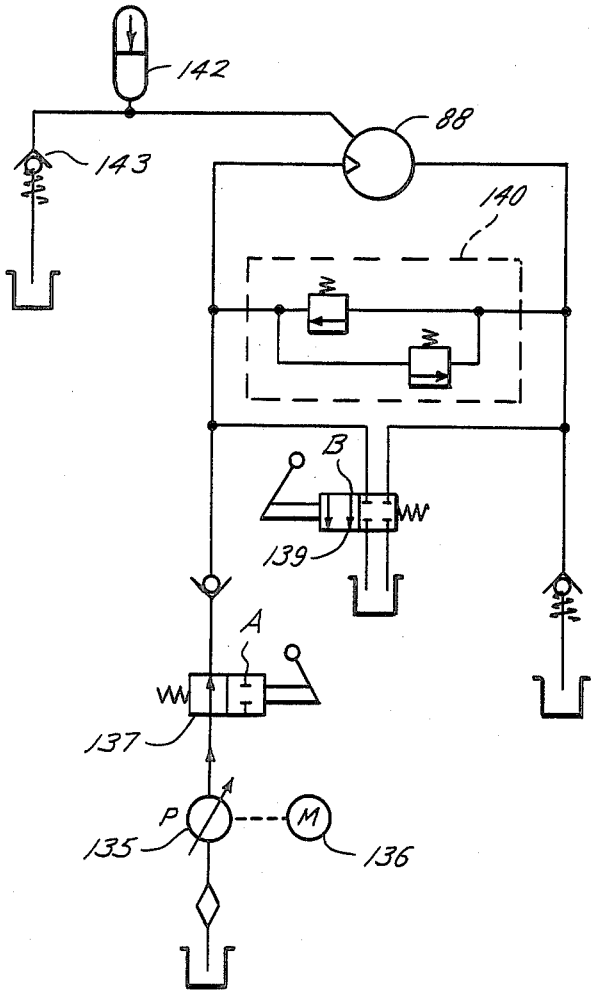

In order to prevent free overrunning of winch sheave 79 with resultant excess slack in leg lines 92, 93, the tensioning control of FIG. 13 is utilized. The motor 88 (FIG. 2) in driving relationship with leg winch sheave 79, is of the hydraulic, radial piston, high torque-low speed type and is normlly free wheeling during the leg elevating cycle, after the platform is out of the water and during the leg lowering until the leg footings are, say, ten feet, more or less, above the bottom, depending, in part, upon the character of the bottom. Motor 88 is placed in the free wheeling mode by moving valves 137 and 139 into positions A and B, respectively, thus draining the motor ports directly to the tank and permitting oil from the accumulator to retract the radial pistons of the motor toward center and hence out of driving engagement. The brake on motor 88 may be manually operated and spring loaded. The motor 88 is placed in driving relationship with "wildcat" sheave 79 after the load of each leg is removed from its motor-gear chain powering means, by engaging band brake 81 and releasing clutch 89. The drive of tensioning motor 88 is set to produce a wind-in force of, say, 10,000 pounds to provide a constant tension of this amount on the leg chain during final descent of the leg to the bottom and, also, after the footings have been impacted and while the platform may still be in the seaway and being elevated out of the water. This amount of restraint, while holding the leg chain taut, is not sufficient to materially reduce the sharply increased rate of dropping of the legs. The result of this is that all legs will strike the bottom at substantially or nearly the same time, even though the hull may continue to rise and fall or otherwise respond to wave action. This is because the time of the final dropping of the legs is materially shorter than the expected wave period, so that there is no danger that hull movement, with the leg slant maintained, will prevent all legs from being firmly planted on bottom together.

CONTROLS

Figure 14:
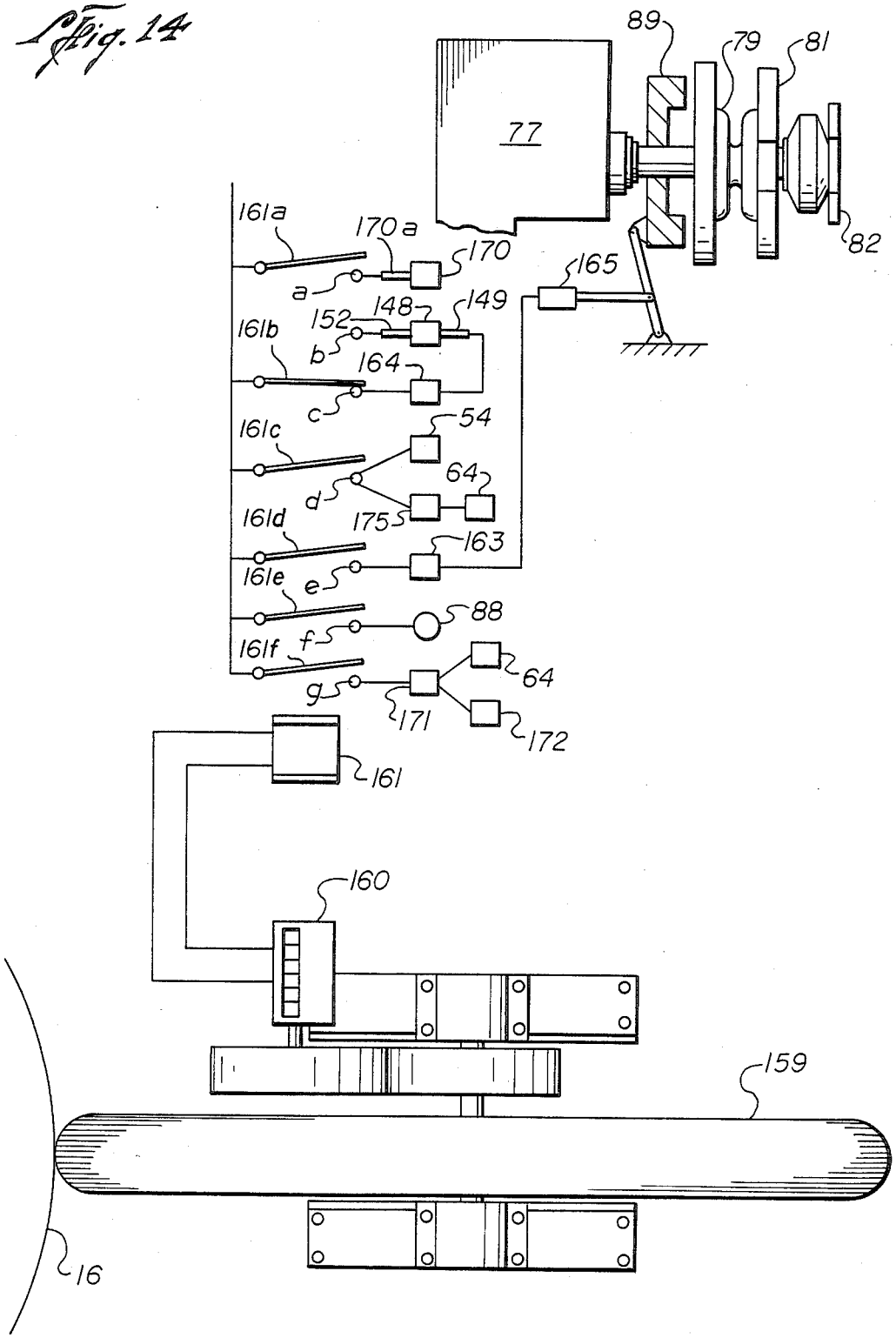

FIGS. 11–14 diagram controls which may be used to activate the various functions. FIG. 14 illustrates means for sensing and/or indicating arrival of the legs, during descent, at a predetermined distance from the bottom, say 10 feet. A wheel or roller 159 journalled on the platform, peripherally engages the surface of one of the leg chords, as 16, to actuate a counter 160 indicating the depth position of the legs. The counter may have one or more predetermined settings, to measure the descent footage of the legs and may include switching means to energize the relay 161 at the predetermined distance from the bottom. The relay has a plurality of contacts 161a–f (FIG. 14), as shown, which, preferably, actuate like controls for all legs through circuit terminals designated a–g.

Figure 12:
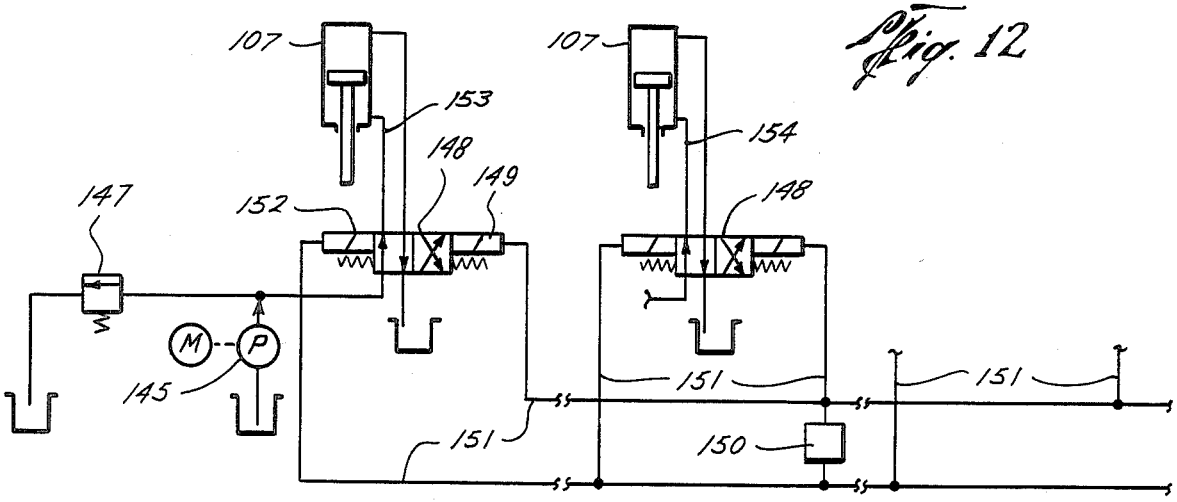

Closing of contact 161*a* opens a switch 170 through terminal a and actuating solenoid 170*a* for cutting off power to all leg driving and restraining motors 75 or 76, which, simultaneously sets all fail-safe brakes and stops the controlled leg descent. At the same time, closing of relay contact 161*b* acts through solenoid 152 to shift valve 148 for applying the band brakes 103 through their motors 107 (FIG. 12). Here, leg angularity enforcing motors 54 may be energized, after removal of pins 60, 51, through contact 161*c* and terminal d, which, after a time delay caused by device 175, also energizes wedge seating motors 64. Next, closing of contact 161*d* through terminal e releases clutch 89, through a motor 165, after a second, brief time delay produced by delay device 163. This is followed by release of the band brakes through contact 161*b* and terminal c, third delay device 164, solenoid 149, and valve 148, having the effect of releasing the legs from lowering restraint by the powering means 75–78 (FIG. 2) and the platform or hull. Thereupon, the legs begin their rapid descent to the bottom. Simultaneously with or quickly after release of the band brakes, anti-slack motors 88 are energized through contact 161*e* and terminal f. However, the restraint of motors 88 is insufficient to materially brake the descent rate of the legs, being merely sufficient to maintain the chains tensioned, as stated.

As an alternative to the load cell means (FIGS. 6 and 6A) for sensing and/or indicating impacting of the legs on bottom, a sixth relay contact 161*f* may be used in connection with terminal g and a fourth timer or time relay device 171 for indicating (indirectly sensing) that the legs have struck bottom. This signal may be used through motor 64 (two-way) to remove the leg slant maintaining wedges, permitting the hull to rise and fall independently of the legs.

The same timing indicator 171, or equivalent, also may be used to initiate hull elevation through suitable switch or other control means.

As another alternative for signalling striking of the legs on bottom, counter 160 may be of the double setting type, arranged to provide a second indication a predetermined time interval after the first, namely, the time required for a final rapid dropping of the legs.

OPERATION

It is believed the operation of the apparatus will be obvious from the above. The platform will be floated to location with the legs vertical and fully elevated, or partially lowered, even to the point where the tanks or cans at the bottoms of the legs have approached the bottom ready for the final, accelerated descent. The lowering of the legs is manually initiated through the switching 150 (FIG. 12) and is at a relative slow rate under the control of the leg powering motors until the legs near the bottom. These leg powering motors, conventionally, are of the type incorporating spring actuated, fail-safe brakes which set when the power fails. Preferably, the first part of the leg lowering action will be performed with the legs remaining vertical. At some point in the descent, pins 50, 51 will be withdrawn and motors 54 energized to slant all legs uniformly and wedges 62 lowered to fix and hold the desired slant positioning. As the legs approach bottom, the band brakes are applied, clutches 89 are released, and then the band brakes 103 are released substantially simultaneously, conveniently at approximately the same time as the energization of the chain tensioning motors 88. This permits rapid leg descent and firm impacting of the footings in the water bottom. Finally, as the legs strike bottom, as sensed by the load cell or time delay devices described above, or otherwise, the wedges are withdrawn so that the platform is free to rise and fall relative to the legs.

Because of the streamlined surfaces of the portions of the legs exposed to wave and wind action, except for the short leg supporting sections 37, and the uniform slanting of the legs, the rig is substantially more stable than previous mobile rigs, yet is substantially less expensive, simpler, lighter, and more durable than previous rigs. These advantages result in greater feasibility of maintining the platform on location for indefinite periods, as for extended or delayed drilling and testing or production purposes. In the latter case, rig operating equipment and drilling equipment may be readily removed, and later replaced if desired.

The advantages of the previously undisclosed means for maintaining the leg slant until the legs strike bottom and the rapidly accelerated dropping rate during the last part of the leg descent are critical to the success of this type of offshore platform individually or when used together. This is because of the resultant firm planting of the legs before release of the slant maintaining means, as well as provision for the striking of all legs on the bottom together and at a uniform angle.

Certain features can be advantageously used in vertical leg platforms, while others are especially useful in connection with slant leg structures. The band brakes may be controlled to serve as the usual fail-safe brakes, or vice versa, a unique feature of the present invention being the capability and concept of releasing the brakes, after they are set, upon cut-off of the leg lowering power. Where an additional band brake is used, the leg lowering power will be cut off and the fail-safe brakes may be rendered inoperative, as by disengagement of a clutch. Moreover, a line tensioning means, as 88 etc., may be applied to the platform lifting lines as well as the descent control lines.

Other features may be modified as will occur to those skilled in the art. For instance, the specific controls and powering means are not essential, moreover, various means for sensing or indicating the approach of the legs to the bottom will become obvious. These and other modification, as will occur to those skilled in the art, may be made in the exemplary embodiments shown without departing from the spirit of the invention and the exclusive use of all modifications as come within the scope of the appended claims is contemplated.

I claim:

1. An offshore, deep water structure including a platform, at least three legs slidably carried thereby, powered means to lower said legs, means to sharply increase the rate of lowering said legs when it is determined that said legs are in proximity with the bottom, means for sensing the approach of said legs into proximity with the bottom, and means responsive to said sensing means to simultaneously release said legs from control by said powered leg lowering means to permit final approach of said legs to the marine bottom, at a rapid, bottom impacting rate.

2. An offshore, deep water structure as described in claim 1 in which said powered means includes means for transmitting power to said legs and said rate increasing means is constructed and arranged to adjust said power transmitting means for substantially free, simultaneous fall of said legs.

3. An offshore, deep water structure comprising a platform, at least three legs slidably carried thereby, powered means to lower said legs including brake and clutch means, means to sharply increase the rate of lowering said legs when it is determined that said legs are in proximity with the bottom, said rate increasing means being constructed and arranged to set said brake means, release said clutch means, and release said brake means for substantially free, simultaneous fall of said legs, means sensing close approach of said legs to the bottom, and means responsive to said sensing means for initiating said rate increasing means.

4. An offshore, deep water structure comprising a platform, at least three legs carried thereby, means to lower said legs, means for sensing approach of said legs to the marine bottom, means responsive to said sensing means to sharply increase the rate of lowering of said legs to the bottom, means for substantially uniformly slanting said legs when in lowered position, wedge means for interposition between said platform and said legs, means for releasing said legs from said leg lowering means as said legs approach the bottom to permit response of said platform to wave action, manual means for shifting said wedge means into slant maintaining position thereof, and control means responsive to engagement of the marine bottom by said legs for shifting said wedge means away from said slant maintaining position thereof.

5. An offshore, deep water structure comprising a platform, at least three legs slidably carried by said platform, powered means on said platform for lowering said legs relative to said platform, and means for releasing said legs from said powered means as said legs approach bottom to permit response of said platform to wave action independently of said legs, said legs being of truss type formed of at least three longitudinal chords, two being inboard of said platform, and connection braces, said chords and braces being cylindrical for minimum resistance to water forces, guides pivotally secured to said platform and with opposed faces slidably receiving said inboard chords, a sheave wheel at at least one extremity of each of said legs, said powered means comprising a winch and tension lines interconnecting said winch with said wheels, said legs, and said platform, motor means for slanting said legs relative to said platform, wedge means for incorporation between said legs and said platform for maintaining said legs in uniform slant position during lowering, and means for releasing said wedge means substantially as said legs strike bottom, to permit independent pivoting of said legs about their bottom contacts.

6. The method of setting up a platform on a marine bottom in deep water which comprises the steps of transporting the platform and legs to location, lowering all legs simultaneously at a first controlled rate of descent part way to the bottom, and sharply increasing the rate of descent of all legs when the legs are determined to be in proximity to the bottom.

7. The method of setting up a platform as described in claim 6 in which the sharp increase in the rate of descent of the legs occurs when the legs are determined to be within approximately the final ten feet of drop to the bottom.

8. The method of setting up a slant leg offshore platform which includes the steps of lowering the legs at a first rate of descent to a level in proximity to the bottom, securing said legs in a predetermined slant position during descent, and thereafter sharply increasing the rate of descent of the legs to the bottom while maintaining the predetermined slant angle of the legs.

9. The method of setting up an offshore platform as described in claim 8 which includes the additional step of releasing the legs from their slant positions as the legs strike bottom.

10. A slant leg offshore, deep water structure comprising a platform, at least three legs slidably carried by said platform, powered means on said platform for raising and lowering said platform and said legs relative to each other and for firmly implanting said legs in the marine bottom, additional powering means for causing and maintaining uniform slanting of said legs during descent thereof, and means for indicating implanting of said legs in the marine bottom and for releasing said slant maintaining means.

11. An offshore, deep water structure comprising a platform, at least three legs carried thereby, powered means to lower said legs part way to the bottom at a first, controlled rate, braking and clutch means applicable to said legs, and control means for increasing the rate of dropping of said legs during descent comprising means for stopping the application of power to said legs and substantially simultaneously applying said braking means and thereafter releasing said braking and clutch means for substantially free fall of said legs the remainder of the way to the bottom.

12. An offshore, deep water structure comprising a platform, at least three legs slidably carried by said platform, means for lowering said legs, means for substantially uniformly slanting said legs and maintaining said legs in slant position, means for sensing striking of said legs on the bottom and means responsive to said sensing means for releasing said maintaining means.

13. Structure as described in claim 12 further including powered means for elevating said platform relative to said legs responsive to said sensing means.

14. The method of setting up, in deep water, a bottom supported platform with slant legs, pivoted leg guides, and leg restraining and platform powering means comprising lowering of said legs to substantial proximity to the bottom, slanting said legs guides and legs to predetermined angular positions relative to the platform, securing said guides in said angular positions, thereafter releasing said legs for substantially free fall into the marine bottom while the guides remain in said angular positions, and releasing said guides for pivoting relative to the platform when it is determined that the legs strike bottom.

* * * * *